United States Patent [19]

Abrams et al.

[11] 4,145,763

[45] Mar. 27, 1979

[54] SEPARABLE MEDICAL UNDERGARMENT

[76] Inventors: Joe L. Abrams, 52 Riverdale Dr.; Luis F. Matta, 16 Hummingbird Rd., Tchefuncta Club Estates, both of Covington, La. 70433

[21] Appl. No.: 748,217

[22] Filed: Dec. 7, 1976

[51] Int. Cl.[2] ..... A41B 9/00

[52] U.S. Cl. ..... 2/403; 128/DIG. 15; 128/288; 2/DIG. 6; 2/406

[58] Field of Search ..... 128/284, 287, 288, 290 R, 128/291, 290 H, DIG. 15; 2/402, 406, 408, 400, 401, 403-405, 407, 238, DIG. 6, DIG. 7, 51, 114; 428/99, 100

[56] References Cited

U.S. PATENT DOCUMENTS

| | | | |
|---|---|---|---|
| 1,489,046 | 4/1924 | Thompson | 2/DIG. 7 |
| 2,166,514 | 7/1939 | Zapis | 2/406 |
| 2,492,620 | 12/1949 | Cohen | 128/288 |
| 2,525,170 | 10/1950 | Ehrlich | 128/288 |
| 2,595,507 | 5/1952 | Beck | 128/288 |
| 2,638,900 | 5/1953 | Gruenberg et al. | 128/288 |
| 2,842,129 | 7/1958 | Ernstorff | 128/288 |
| 3,460,535 | 8/1969 | Behna | 128/288 |
| 3,768,481 | 10/1973 | Shibata | 128/288 |
| 3,824,625 | 7/1974 | Green | 2/114 |
| 3,828,785 | 8/1974 | Gamm et al. | 128/288 |
| 4,022,212 | 5/1977 | Lovison | 128/288 |

FOREIGN PATENT DOCUMENTS

| | | | |
|---|---|---|---|
| 620310 | 11/1962 | Belgium | 2/403 |
| 406200 | 12/1909 | France | 128/288 |

*Primary Examiner*—Robert W. Michell
*Assistant Examiner*—C. W. Shedd
*Attorney, Agent, or Firm*—Guy W. Shoup

[57] ABSTRACT

An undergarment for use in surgical, medical or other medical treatment environments, comprising at least two completely separable cloth panels, said panels being separable one from the other, the separation and fastening being effected by the use of Velcro® or similar adhering materials. The undergarment may also contain a slit positioned near the urinary tract for a catheter or drain and/or adhering means for keeping a folded-back upper or lower side or crotch portion of the undergarment open and secured in place during examination, treatment or surgery, both said slit and said adhering means being sealable also by use of Velcro® or similar adhering material.

2 Claims, 7 Drawing Figures

SEPARABLE MEDICAL UNDERGARMENT

BACKGROUND OF THE INVENTION

1. Field of the Invention

The invention relates to undergarments having specialized and necessary uses in hospital, nursing home and other surgical and other medical treatment settings.

2. Description of the Prior Art

Present practice in hospitals, nursing homes and other facilities where surgical and medical treatment is practiced finds patients dressed only in various types of normal undergarments and, additionally, loose-fitting gowns, robes or long pajama-top type garments.

The undergarments must be completely removed for a large number of surgical and medical procedures. Thus, on many occasions, the loose-fitting gowns, robes or other garments are the patients' only garment. Therefore, embarrassment and concern with body exposure and possible body exposure is a common feeling both on the part of both patients and those who are strangers to hospital environments and in contact with patients, for example, visitors. This problem is more extreme among paraplegics and hemiplegics and children (who must remove their undergarments even for a tonsillectomy) as well as patients undergoing radiological examinations of all types.

Separable or partially separable fitting undergarments that completely cover the groin area and yet allow for ease of examination, treatment and/or surgery are not presently provided for patients in hospital and nursing home settings. Available conventional fitted undergarments present great difficulty of access to the lower abdomen, groin and lower back areas during examination, treatment and surgery. In short, conventional fitted undergarments fail to allow any degree of highly selective or limited access to portions of or the entire lower abdomen, lower back and genital area for purposes of diagnostic examinations, surgery and continuing treatment in and near those areas of the body.

Apart from the conventional fitted undergarment described above, prior art patents indicate that attempts have been made in the past to solve the problems solved by our invention, but they, to our knowledge, have apparently not been commercially developed. Some prior art patents show separability of one or more sides of the garment, or the crotch, but not both sides and the crotch of ordinary garments and undergarments which are not intended for hospital use. They include U.S. Pat. Nos. 1,030,943, 1,281,058, 1,966,060, 1,995,531, 2,326,380, 2,525,170, 2,623,210 and 2,443,474. Materials and devices used to achieve separability of one or more sides or the crotch of these garments include buttons, zippers and drawstrings. However, as pointed out, no garment disclosed is completely separable along both sides and the crotch or, importantly, refastenable along both the sides and/or the crotch of the garment.

Prior art patents intended for medical use have the same limitations as the patents in the preceding paragraph. They include U.S. Pat. Nos. 1,895,343, 2,520,026 and 3,144,659, all of which have at least one area covering the body, ordinarily closed in a fitted garment, completely open, thus making a portion of the body visible, or possibly visible, at all times. Some prior art patents show garments with an openable crotch but integral and closed sides. They include U.S. Pat. Nos. 2,548,660, 2,396,599, 2,397,641 and 3,029,814. Again, these use buttons, snap fasteners and unwieldly "tunnel forming members" and lack speed and selectivity of access by medical personnel and complete fastenability.

While the above prior art describes, separately, complete separability of both sides of a pair of shorts (an undergarment), and, separately, a severable or open crotch, the prior art discussed above does not show both features in the same garment or recognize the need therefor. Further, none of the above-discussed prior art garments show partial severability and complete fastenability which enable a high degree of selectivity of access to the lower abdomen, lower back and genitourinary area.

OBJECTS AND FEATURES OF THE INVENTION

An important feature of the present invention is the provision of an undergarment which is convenient and flexible in allowing highly selective access by a physician, nurse or other medical personnel to the entire lower abdominal, lower back and genitourinary area of a patient for many purposes. These purposes include appendectomies and other lower abdominal surgery, obstetrical and gynecological examinations and surgery, urological and rectal examinations and surgery, and diagnostic procedures, such as proctoscopies, radio contrast enemas and X-rays.

Another important feature of the present invention is provision of an undergarment which allows quick and, if necessary, fastened and yet partially open access, so important in some medical and surgical techniques, to selected portions of the lower abdominal, back and genitourinary area, without the jamming and other difficulties caused by, for example, zippers or the slowness of fastening open an area with, for example, snaps.

Another important feature of the present invention is its provision of such an undergarment which affords psychological comfort and security, and great reduction of potential embarrassment by allowing a substantial degree of privacy for the patient when he is seen by hospital staff, other patients and visitors during all phases of a patient's treatment or ambulation within the hospital. This is true regardless whether the patient is wearing a loose open or partially open gown over the undergarment.

Another feature of the invention is the provision of such an undergarment that permits the patient to wear the undergarment and, at the same time, permits insertion of a rectal thermometer or drain tube, allows simple access for rectal examinations, proctoscopies and vaginal examinations, and, additionally, permits easy clothing of the patient's lower body while in a supine, prone or semi-Fowler's position (in which the upper part of the body is held at an angle of approximately 45°), as well as, additionally, providing an easily openable and sealable orifice for a urinary catheter, tube or drain, or an orifice for male urination.

Another feature of the invention is that the undergarment of the present invention is nonconductive and non-metallic, thereby permitting, for example, electrocautery and X-rays, and is without external or internal fittings, such as buttons, hooks or drawstrings which tend to make manual manipulations cumbersome.

Another feature of this invention is that it makes possible a sterile and disposable undergarment utilizable for many medical and surgical procedures and which eliminates the possibility of contamination or infection by micro-organisms present in commercially laundered conventional garments.

Another feature of the invention is that the undergarment of the present invention acts as a cushion for a recuperating patient who must remain in a supine, prone or semi-Fowler's position, thereby reducing the pressure in a particular area and thereby reducing the incidence of decubitus ulcers or bedsores.

Another feature of the undergarment of the present invention is that the rectum and urinary tract may be protected during surgery on other areas of the body from accidental contamination by means of spontaneous discharges from within the body.

Still another feature of the undergarment of the present invention is that it provides a dressing or covering which meets the sterility standards of the operating room, which is particularly useful for the rectal-perineal area of the body, which is a difficult area to clean and prepare for surgical procedures.

A further feature of the invention is that the undergarment is a multi-purpose garment for general use in all areas of surgical, medical and nursing environments; for example, the undergarment may be used in preparatory, operating and recovery rooms, in a nursing home or in a doctor's office; it may be used for a patient undergoing an examination or an operation, for physical therapy or X-ray patient, or for patients recuperating in a bed or wheel chair.

Still another feature of the undergarment of the present invention is that it may prevent accidental or inadvertent exposure of lower bodily parts by hyperactive neurosurgical patients or by patients undergoing extended radiological examinations.

SUMMARY OF THE INVENTION

This invention relates to undergarments for use in all medical treatment environments and has particular reference to an undergarment which is completely separable into two or more cloth panels and which provides highly selective access by a doctor, nurse or other medical or surgical personnel to the entire lower abdomen, groin and lower back area, for examination, treatment and surgery.

An embodiment of the undergarment has a slit which, when open, allows a catheter or drain tube to exit from the urinary tract. A further embodiment contains means for keeping either a rolled back or folded back portion of the garment secured in place during examination, treatment or surgery. The flexibility of uses of the undergarment is due to its method of construction and to the use of Velcro ®-type material at its joining seams, which permits selection of a firmly fastened seam, a partially detached seam, a partially opened seam or opening or a fully detached and separated seam.

While the invention will be described with certain preferred embodiments, it will be understood that the description is not intended to so limit the invention. On the contrary, the description is intended to include all alternatives, modifications and equivalent arrangements as may be included within the scope and spirit of the invention as expressed in the appended claims.

The preferred embodiment as described herein uses Velcro ®-type surfaces to removably fasten various seams of the garment together. The Velcro ®-type of securing means employs two tapes, one on each of the two pieces of the garment to be fastened together. The surface of one tape consists of a large number of closely spaced hooks, and the surface of the other tape is a felt-like material with numerous, closely-spaced loops. When the hook and loop surfaces are pressed together, the hooks catch the loops and the two elements are secured together firmly until they are intentionally separated.

This use of Velcro ®-type surfaces is only one of several securing means that may be employed. Other types of convenient, sterile fasteners may include, for example, a self-adhesive tape of micro-smooth plastic resin film which removably adheres by exclusion of air and is fastenable only to a mating surface of a type of the same material.

Both the Velcro ®-type of tape and the micro-smooth plastic tape are within the term "substantially continuous removably fastenable non-sticky mating surface," as used herein. This is a special term, as used herein, in the specification and claims, and is defined below for such usage. That term, as used herein, means one surface of a pair of mating surfaces; each of which (i) when fastened together will form a substantially continuous closure—and not a closure with gaps such as are formed by a tandem line of snaps or buttons; (ii) is applied with some pressure to another mating surface with the pressure being generally vertical to the surface; (iii) will readily adhere only to a unique matching mating surface, such adhesion occurring after being applied with some pressure; (iv) will substantially adhere to its matching mating surface until pulled off using some pulling tension; (v) is non-sticky, i.e., is not sticky to the touch when wet or dry; (vi) is a fastening surface without electrical or magnetic conductivity; (vii) is not a set of snaps or a zipper or a set of hook-type fasteners.

BRIEF DESCRIPTION OF THE DRAWINGS

FIG. 3 also shows the catheter or drainage tube opening partially open in flap form.

DETAILED DESCRIPTION OF THE INVENTION

Figure 1:
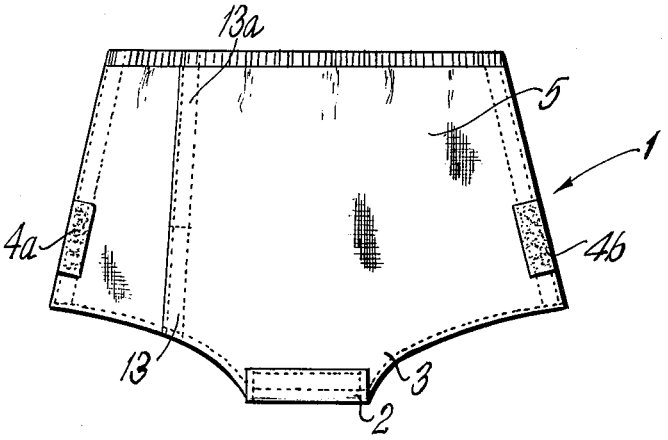
FIG. 1 is a front plan view or outside view of the garment with all of the separable surfaces fastened together.

A preferred embodiment of the invention is shown in FIG. 1, where the undergarment 1 is shown as it would normally be worn. The garment panels of the undergarment are of "cloth," which means any flexible material, and is preferably of woven cotton but may be made of any other material suitable for underclothing or of a disposable material such as a felted paper. Preferably the cloth is sufficiently inexpensive so that the undergarment may be used by only one patient and then destroyed. The embodiment of FIGS. 1, 2*a*, and 2*b* and 3 utilizes Velcro ®-type surfaces, although other types of removably adherent non-sticky mating surfaces, as defined herein, may alternatively be used.

In undergarment 1 both sides and the crotch of the undergarment are removably fastened together to form a completely fastened-together and fitted undergarment using the Velcro ®-type surfaces for its side and crotch fastening. The undergarment 1 includes a front cloth panel 5 of somewhat rectangular configuration having curved bottom edges and having a descending integral flap portion 3. The body of the panel 5 has a generally straight top (for the waistband), two opposed sides, which are inwardly tapered in FIGS. 1, 2*a*, 2*b* and 3, and a bottom configuration having downwardly and inwardly curved edges. If desired, the opposed sides may be more or less parallel instead of tapered. Two external Velcro ®-type surfaces 4*a* and 4*b* are secured on the outer face of cloth panel 5 and are preferably formed by a short length of Velcro ® tape sewed on the left and right edges, respectively, of panel 5. The undergarment 1 also includes a closed crotch 2.

Each of the Velcro ®-type surfaces is the surface of a plastic resin tape, about one-half inch in width, whose smooth side is placed against the cloth panel. The tape is preferably sewed to the cloth panel by parallel sewing lines on opposite edges of the tape.

Figure 2A:
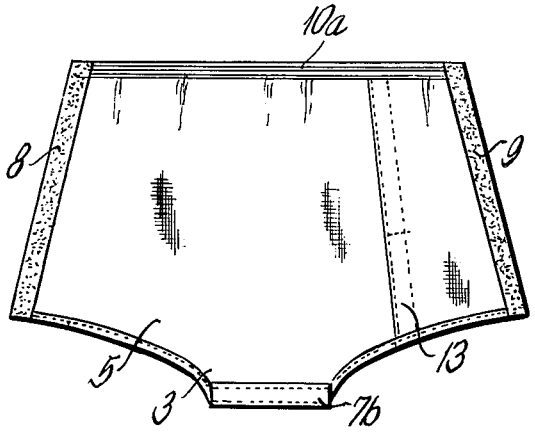
FIG. 2*a* is a plan inside view (from within) of the front panel of the garment, i.e., the reverse side of the front panel, separated and not connected to the back panel of the garment.
Figure 2B:
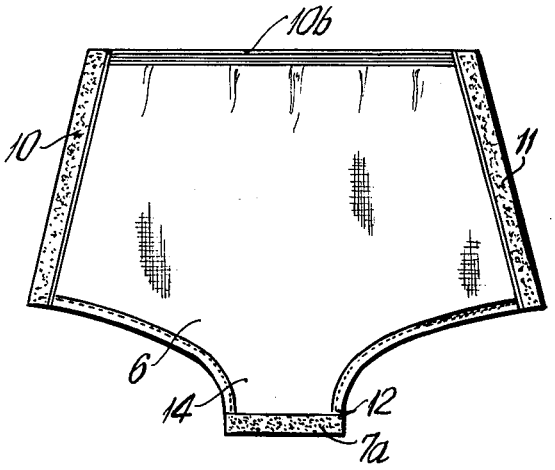
FIG. 2*b* is a plan inside view (from within) of the rear panel of the garment separated from the front panel of the garment.

FIGS. 2*a* and 2*b* show, separately, each of the two panels of the undergarment of the present invention. FIG. 2*a* shows the front panel 5 viewed from the inside and FIG. 2*b* shows the rear panel 6 viewed from the inside. A conventional elastic waistband 10*a* and 10*b*, which is a partial waistband on each panel, is preferably provided at the top of each of the panels 5 and 6. Velcro ® tapes 8 and 9 are secured along the left and right edges (as seen in FIG. 2*a*) of the front panel 5. Mating Velcro ® tapes 10 and 11 are secured along the left and right edges (as seen in FIG. 2*b*) of the back panel 6. When the garment 1 is fully fastened together, as shown in FIG. 1, the surfaces of tapes 9 and 10 removably adhere together and the surfaces of tapes 8 and 11 removably adhere together.

The attachment at the crotch area is also made by two Velcro ®-type surfaces. One of these surfaces 7*a* is on the inside and along the bottom edge of a central descending flap 12, integral with the back panel 6. The other Velcro ®-type surface 7*b* is external to flap 3 and along the bottom edge of flap 3. Alternatively, and not shown, the front panel 5 may have a descending flap, with a Velcro ®-type surface along its inner edge, to be folded over and removably attached to a mating Velcro ® surface exterior to the rear of flap 14 of panel 6. The crotch attachment 2 is made by passing the integral bottom flap 3 of the back panel 5 between the patient's legs and then adhering the two Velcro ®-type surfaces.

A catheter opening 13 is preferably located on the front panel 5 and is removably fastened in a closed position by two Velcro ®-type surfaces which each extend up to any preselected point in the garment panel. The opening 13 is an open bottom end portion of the overlapping double-sewed seam 13*a*.

Figure 3:
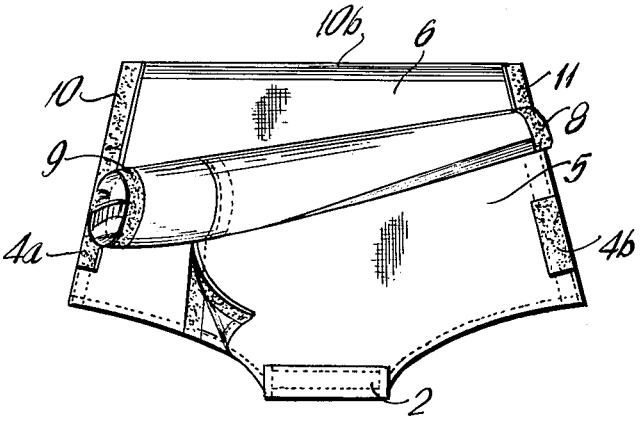
FIG. 3 is a front perspective view of the garment of FIGS. 1, 2*a* and 2*b* partially folded, with the upper portion of the front panel on the left-hand side being partially detached and secured to the lower Velcro ®-type portion and the upper portion on the right-hand side being open to show initial partial detachment.

FIG. 3 illustrates the further flexibility of the present invention. It shows the initial partial separation of the front panel 5 on the upper left-hand side. That partial separation is followed by the attachment of the top portion of the internal Velcro ®-type surface 9 to an external Velcro ®-type surface 4*a* (on the left) to permit partial exposure of the abdomen. On the right side of FIG. 3, the top portion of the front panel 5 has been partially pulled away from the rear panel 6, and the Velcro ®-type surfaces 8, 11 have been partially separated. The right side of front panel 5 has been rolled down part of the way to expose the lower abdomen and it is in a position to be further rolled down and secured in place by means of the Velcro ®-type surface 4*b* attached to the front face of panel 5. Similar external Velcro ®-type surfaces (similar to 4*a*, 4*b*), not shown, may also be placed on the rear face of panel 6 so that portions of the buttocks or rectum may be exposed. Further, the Velcro ®-type surfaces may be so attached as to cause the panel edges to overlap and not face each other.

What is claimed is:

1. A separable undergarment for surgical, hospital and nursing use, comprising (a) a front panel of cloth whose upper edge forms a partial waistband and having opposed sides and having a central integral flap to form a crotch portion, said front panel having substantially continuous removably fastenable non-sticky mating surfaces along each side and along the lower edge of said flap;

(b) a back panel of cloth removably adhered to said front panel, said back panel having an upper edge forming a partial waistband and having opposed sides and having an integral central descending flap to form said crotch portion with said other flap, said back panel having substantially continuous removably fastenable non-sticky mating surfaces along each side and along the lower edge of said flap;

(c) wherein said front panel and said back panel may be fully or partially separated by pulling apart appropriate substantially continuous removably fastenable non-sticky mating surfaces;

(d) at least one of said panels further containing at least one substantially continuous removably fastenable non-sticky mating surface secured to its external face at one of its side edges;

(e) whereby when a portion of said one panel is detached from the other panel and rolled partially over, said exterior substantially continuous removably fastenable non-sticky mating surface serves to removably attach said rolled-over portion of said one panel;

(f) thereby permitting said one panel to remain in a partially folded-over position and thereby permitting a portion of the lower abdomen or back to be exposed.

2. A separable undergarment as claimed in claim 1

(a) wherein the crotch flap of said back panel is longer than the crotch flap of said front panel, (b) thereby allowing said crotch flap of said back panel to be attached to said crotch flap of said front panel on the anterior side of the patient.

* * * * *